United States Patent [19]

Wilms et al.

[11] 4,028,764

[45] June 14, 1977

[54] APPARATUS FOR LASTING FOOTWEAR UPPERS

[75] Inventors: Gerard J. M. Wilms, Son; Hendrik C. J. Joosten, Eindhoven, both of Netherlands

[73] Assignee: Bata Shoe Company, Inc., Belcamp, Md.

[22] Filed: Jan. 22, 1976

[21] Appl. No.: 651,437

[30] Foreign Application Priority Data

Jan. 22, 1975 United Kingdom ..... 2859/75

[52] U.S. Cl. ..... 12/1 W; 156/382

[51] Int. Cl.[2] ..... A43D 00/00

[58] Field of Search ..... 12/1 R, 1 F, 1 W, 8.1, 12/7

[56] References Cited

UNITED STATES PATENTS

| | | | |
|---|---|---|---|
| 3,160,899 | 12/1964 | Bille et al. | 12/1F |
| 3,422,475 | 1/1969 | Hart | 12/8.1 |
| 3,512,197 | 5/1970 | Carr | 12/1 W |

*Primary Examiner*—Patrick D. Lawson

[57] ABSTRACT

A lasting apparatus for footwear, in which a flexible tubular diaphragm shapes the footwear upper and forces it onto the insole by means of vacuum applied to the interior of the diaphragm. The last and its associated support act to seal one end of the diaphragm. Preferably, an H-shaped guide is provided to form pleats in the diaphragm as it collapses at defined positions in relation to the article being lasted.

7 Claims, 2 Drawing Figures

APPARATUS FOR LASTING FOOTWEAR UPPERS

This invention relates to apparatus for shaping and lasting footwear uppers by the use of differential pressure on a flexible diaphragm.

It is known to shape an upper to a last by the use of a flexible diaphragm partially defining a closed chamber around the upper and last, the diaphragm being drawn onto the upper by application of vacuum to said chamber. In most such known arrangements, the diaphragm is planar.

These known arrangements suffer from the disadvantage that only part of the upper can be shaped and lasted at a time.

An object of the present invention is to provide an improved method and apparatus for shaping and lasting uppers, which is simple and cheap in use, and which is suitable for a high degree of automation.

Accordingly , the invention provides apparatus for shaping and lasting footwear uppers, comprising a chamber formed by a tubular flexible diaphragm, and an end wall at one end thereof, a last mounted on a last support, the last support being adapted to sealingly engage the other end of said tubular diaphragm to close the chamber with the last inside, and means for connecting the interior of said chamber to a vacuum source.

Figure 1:
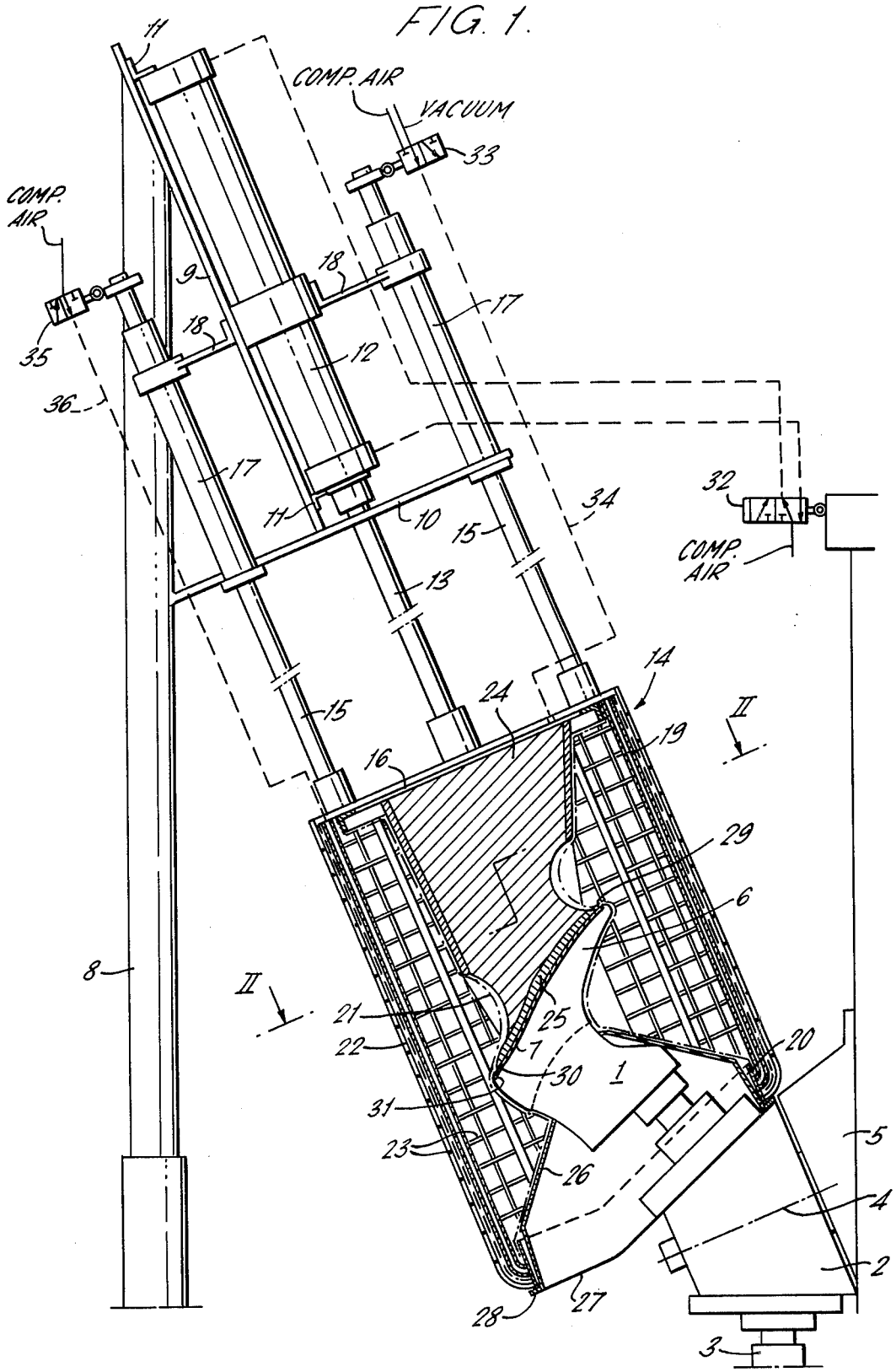
Figure 2:
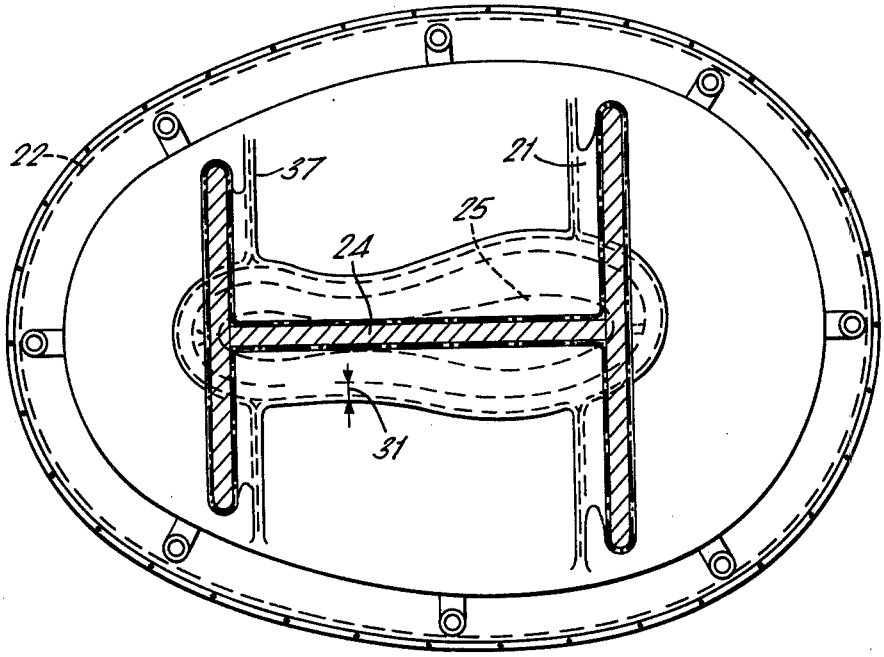

An embodiment of the invention will be described, by way of example, with reference to the accompanying drawings, in which:

FIG. 1 is a side elevation, partially in section, of apparatus embodying the invention; and FIG. 2 is a cross-section on the line II—II of FIG. 1.

A frusto-conical last support 2 is mounted for rotation about an axis 4 on a support 5. A plurality of supports 5 are equispaced around a turntable (not shown) for indexing between various treatment stations.

The last support 5 carries diametrically opposed lasts 1, 3 which may be held in the positions shown, for example by a resilient pawl.

Although not forming part of the present invention, the apparatus is suitably arranged so that at a first station completed work is removed from the last 3 while an insole and an upper are fastened in position on the last 1, at a second station the upper is heated by hot air, at a third station the apparatus to be described secures the upper to the insole in accordance with the invention, and at a fourth station the work is cooled by blowing cold air.

Returning to FIG. 1, a fixed frame 8 is provided with plates 9 and 10 welded obliquely thereto. A pneumatic piston-and-cylinder actuator 12 is mounted by means of angle irons 11 to the plate 9. The piston rod 13 of the actuator 12 carries a vacuum cage assembly generally indicated at 14, the cage assembly 14 being slidably guided by parallel rods 15 engaging guides 17 mounted on the plate 10 and interconnected by supports 18.

The cage assembly 14 comprises an end plate 16 to which are welded equispaced tubes 19 forming a cage-like frame-work. The tubes 19 are bent inwardly at right angles at their lower ends and welded to a sealing ring 20. A first tubular diaphragm 21 of resilient material such as silicone rubber is sealed in a gas-tight manner at its end to the end plate 16 and sealing ring 20, its tubular surface lying adjacent the inner periphery of the tubes 19. A second tubular member 22, suitably of transparent material, is positioned around the outer periphery of the tubes 19 and secured in a gas-tight seal to the end plate 16 and the sealing ring 20, and is itself surrounded by a woven wire tubular cage 23 fixed to the end plate 16 and sealing ring 20.

A pleat guide 24 of rigid material (such as wood, synthetic plastics or metal) is mounted within the cage assembly 14 on the end plate 16. The pleat guide 24 is of H-shaped cross-section, and the "legs"of the H are at approximately the positions of the centres of the heel and toe portions of the shoe to be shaped, while the cross-piece of the H lies in a plane through the centre-line of the shoe. The legs of the H taper towards each other in the direction towards the last 1 and terminate at a distance from the position of the last 1 when in the cage assembly 14. The cross-piece of the H extends beyond the legs and is provided at its free end with a resilient pressing strip 25 for an insole 7, the pressing strip in use shaping the profile of the insole to the last.

A truncated conical support 26 is provided around the shaft of the last 1. The support 26 is mounted on a bottom plate 27 which carries a sealing strip 28 positioned around the lower periphery of the support 26 for cooperation with the sealing ring 20.

In use, the insole 7 is fixed to the last 1 by means of two short obliquely forwardly directed pins 29 at the toe portion and a short vertical pin 30 at the heel. The upper 6 is manually positioned over the last 1 and the last margin 31 is adhered to the precemented insole 7 at some points at the toe portion and between the heel and the toe.

When this assembly reaches the third station mentioned above, a distribution valve 32 supplies compressed air to the cylinder 12, thus lowering the vacuum cage assembly over the last 1 until the sealing ring 20 seats against the sealing strip 28, after which the compressed air supply to the cylinder 12 is closed. A second distribution valve 33 actuated by one of the guide rods 15 then connects a vacuum pump (not shown) to the chamber within the first tubular diaphragm 21 by means of a conduit 34, thus evacuating the chamber. The diaphragm 21 presses the upper 6 onto the last 1 and simultaneously folds the lasting margin 31 inwardly around the edge of the insole 7, pressing the lasting margin 31 against the marginal portion of the insole. The support 26 prevents excessive deformation of the diaphragm 21.

A third distribution valve 35, controlled by the other guide rod 15 supplies compressed air via a conduit 36 to the space between the diaphragms 21 and 22 to increase the pressure on the lasting margin 31. This is particularly desirable when shaping heavy and/or stiff materials, and could be omitted in other cases. The air supply is suitably at a pressure of up to 3kg/cm$^2$.

The pleat guide 24 acts to cause the pleats which necessarily form as the diaphragm 21 collapses, to be formed as indicated at 37, two at the heel and two at the toe, which prevents or minimises formation of pleats in the lasting margin 31.

After lasting, the valve 33 introduces compressed air within the diaphragm 21 to quickly release it from the last. The valve 32 then supplies air to the cylinder 12 to return the cage assembly 14 to its upper position.

We claim:

1. Apparatus for shaping and lasting footwear uppers, comprising a chamber formed by a tubular flexible diaphragm and an end plate at one end thereof, a last mounted on a last support, the last support being adapted to sealingly engage the other end of said tubular diaphragm to close the chamber with the last inside, means for connecting the interior of said chamber to a vacuum source, and a pleat guide mounted within the chamber on the end plate.

2. Apparatus according to claim 1, in which the pleat guide is of H-shaped cross-section, the centre piece of which extends beyond the remainder and mounts a pressing strip for an insole.

3. Apparatus according to claim 1, in which the last support comprises a frusto-conical member carried by a base plate, and a sealing strip on the base around the periphery of said frusto conical member.

4. Apparatus according to claim 1, including a second diaphragm surrounding said tubular flexible diaphragm, and means for pressurising the space between the diaphragms.

5. Apparatus according to claim 4, including a sealing ring at the lower end of said flexible tubular diaphragm, and a plurality of parallel, circumferentially spaced members extending between said end plate and the sealing ring adjacent the inner periphery of the second diaphragm.

6. Apparatus according to claim 1, in which said chamber is movable to engage and disengage from the last support.

7. Apparatus according to claim 1 including a pleat guide of H-shaped cross-section mounted within the chamber on the end plate, a second diaphragm surrounding said tubular flexible diaphragm, means for pressurising the space between the diaphragms, and means mounting said chamber for movement to engage with and disengage from said last support.

* * * * *